US008375677B1

(12) United States Patent
Weiler

(10) Patent No.: US 8,375,677 B1
(45) Date of Patent: Feb. 19, 2013

(54) INSULATED POURED CONCRETE WALL STRUCTURE WITH INTEGAL T-BEAM SUPPORTS AND METHOD OF MAKING SAME

(76) Inventor: Neal Ray Weiler, Denver, PA (US)

( * ) Notice: Subject to any disclaimer, the term of this patent is extended or adjusted under 35 U.S.C. 154(b) by 0 days.

(21) Appl. No.: 12/924,256

(22) Filed: Sep. 23, 2010

Related U.S. Application Data

(60) Provisional application No. 61/277,302, filed on Sep. 23, 2009.

(51) Int. Cl.
*E04B 1/00* (2006.01)

(52) U.S. Cl. ..... 52/745.1; 52/319; 52/367

(58) Field of Classification Search ..... 52/319, 52/367, 371, 376, 745.1; 249/15, 33, 34, 249/83, 39, 40, 41, 42, 43, 44, 45, 46, 47
See application file for complete search history.

(56) References Cited

U.S. PATENT DOCUMENTS

| | | | | | |
|---|---|---|---|---|---|
| 3,415,023 | A | * | 12/1968 | Lebreton | 52/213 |
| 4,291,513 | A | * | 9/1981 | Ankarswed | 52/284 |
| 4,541,211 | A | | 9/1985 | Garrett | |
| 4,570,398 | A | | 2/1986 | Zimmerman | |
| 4,605,529 | A | | 8/1986 | Zimmerman | |
| 4,751,803 | A | | 6/1988 | Zimmerman | |
| 4,934,121 | A | | 6/1990 | Zimmerman | |
| 5,055,252 | A | | 10/1991 | Zimmerman | |
| 5,313,753 | A | | 5/1994 | Sanger | |
| 5,381,635 | A | | 1/1995 | Sanger | |
| 5,409,193 | A | | 4/1995 | Baxter | |
| 5,656,194 | A | | 8/1997 | Zimmerman | |
| 5,692,356 | A | * | 12/1997 | Baxter | 52/309.11 |
| 5,845,445 | A | * | 12/1998 | Blackbeard | 52/426 |
| 5,987,830 | A | | 11/1999 | Worley | |
| 5,992,114 | A | | 11/1999 | Zelinsky et al. | |
| 6,003,278 | A | * | 12/1999 | Weaver et al. | 52/414 |
| 6,338,231 | B1 | | 1/2002 | Enriquez | |
| 6,427,406 | B1 | | 8/2002 | Weaver et al. | |
| 6,438,917 | B2 | | 8/2002 | Kubica | |
| 6,463,702 | B1 | * | 10/2002 | Weaver et al. | 52/79.1 |
| 6,494,004 | B1 | | 12/2002 | Zimmerman | |
| 6,622,452 | B2 | | 9/2003 | Alvaro | |
| 6,634,148 | B2 | | 10/2003 | Shidler | |
| 7,059,577 | B1 | * | 6/2006 | Burgett | 249/40 |
| 7,124,547 | B2 | * | 10/2006 | Bravinski | 52/426 |
| 7,530,203 | B1 | | 5/2009 | Hare et al. | |
| 2009/0173870 | A1 | | 7/2009 | Long, Sr. | |
| 2009/0301030 | A1 | * | 12/2009 | Nojima et al. | 52/782.1 |

* cited by examiner

*Primary Examiner* — Mark Wendell
(74) *Attorney, Agent, or Firm* — Michael R. Swartz

(57) ABSTRACT

An insulated concrete wall structure having integral T-beam supports is fabricated onsite by pouring uncured concrete into spaced apart forms that define a wall cavity. Within the wall cavity are a plurality of insulation panels so positioned and arranged in defining an outer wall cavity for forming a concrete outer wall, a support wall cavity for forming a support wall that is integral with the outer wall and together define a T-beam support, and a box beam cavity for forming an elongated box beam that interconnects the upper ends of the T-beam supports together.

14 Claims, 10 Drawing Sheets

6

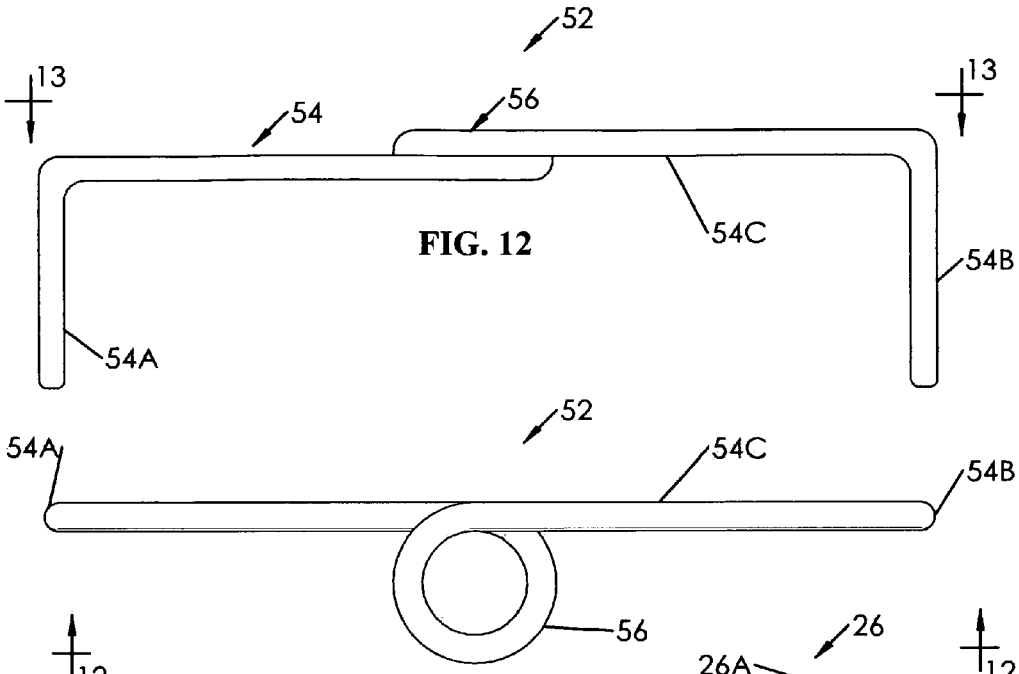
FIG. 12
FIG. 13
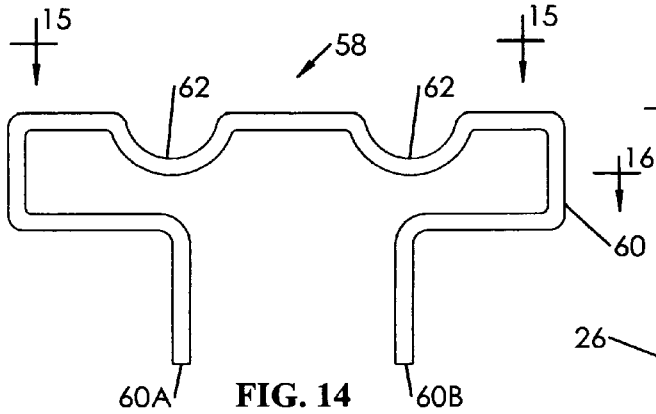
FIG. 14
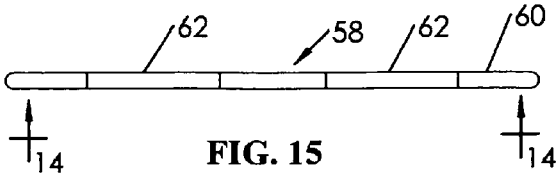
FIG. 15
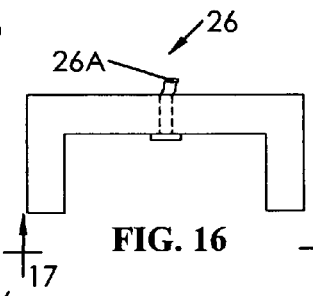
FIG. 16
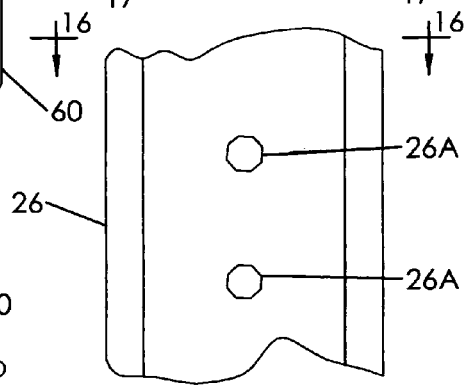
FIG. 17

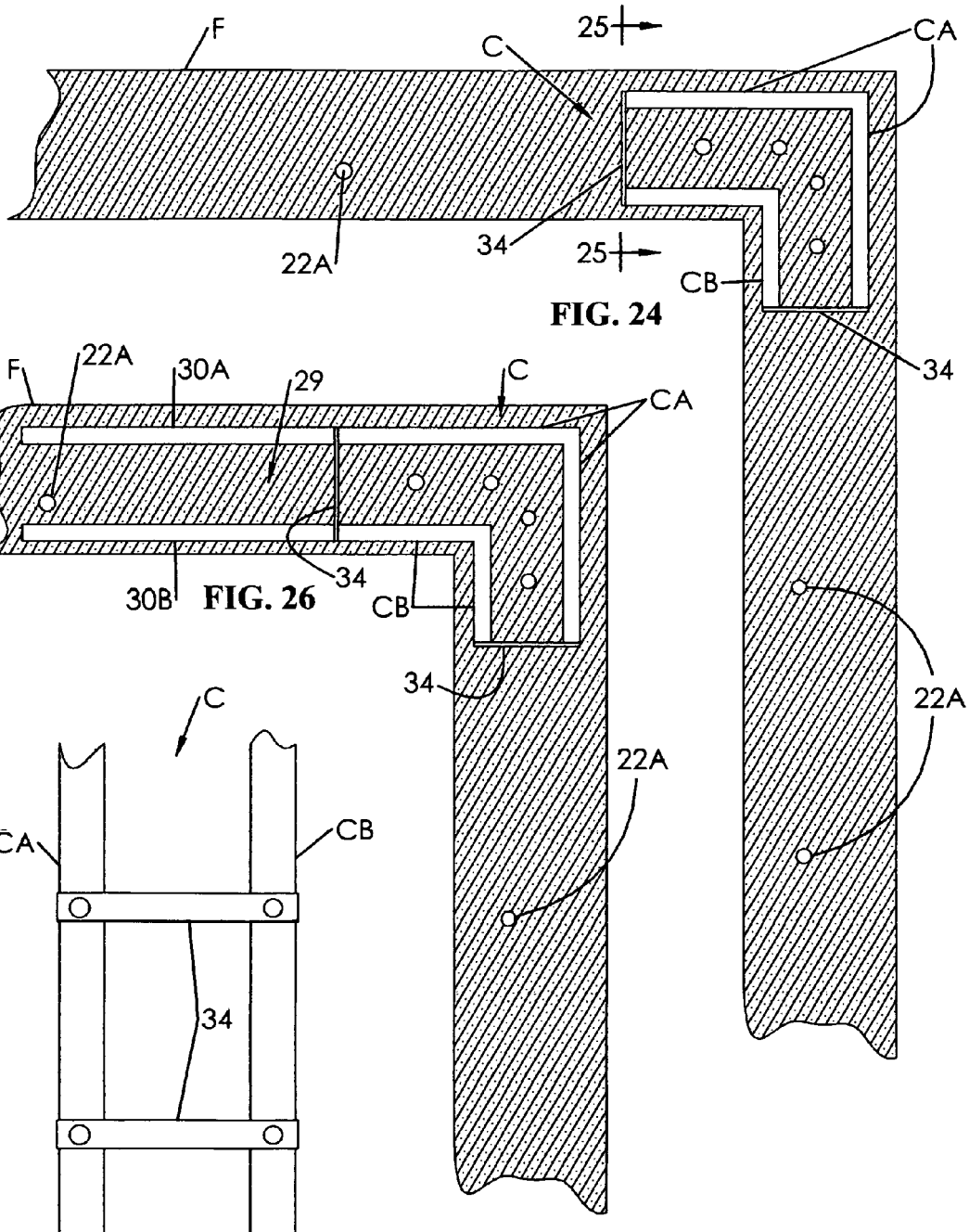
FIG. 24
FIG. 26
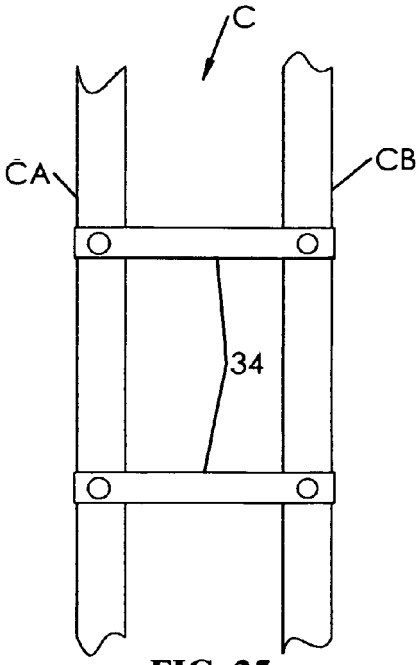
FIG. 25

INSULATED POURED CONCRETE WALL STRUCTURE WITH INTEGAL T-BEAM SUPPORTS AND METHOD OF MAKING SAME

This patent application claims the benefit of U.S. provisional application No. 61/277,302; filed Sep. 23, 2009.

BACKGROUND OF THE INVENTION

1. Field of the Invention

The present invention generally relates to building wall structures and, more particularly, is directed to an insulated poured concrete wall with integral T-beam supports and the method of making same on site.

2. Description of the Prior Art

Concrete walls can be formed in various ways. Some are constructed from concrete blocks on footings, some can be formed by pouring or pumping in uncured concrete between rigid forms, and others can be made from prefabricated members which are becoming very popular. The traditional concrete block method for wall construction involves laying many courses of block, one on top of another, to build a vertical wall wherein each block must be individually placed and surrounded by mortar. This method is both time consuming and labor intensive.

Poured concrete walls have many benefits over other types of concrete walls. They can be quickly constructed, are relatively easy to construct, are versatile, and durable. The poured wall forms are generally planar structures and typically made of wood, aluminum, steel, or a combination of these materials. For poured walls, two series of coplanar wall forms are held in a spaced apart, generally parallel relationship to create the cavity which will form the concrete wall. The wall forms are typically held in the correct spaced apart relationship by a series of retaining (cross) ties extending between the form assemblies. The retaining ties commonly include holes formed in each end whereby pins are used to join adjacent coplanar forms together. Once the wall forms are in place, concrete is poured into the cavity between the forms and, after the concrete has cured, the forms are disassembled for reuse. The protruding ends of the retaining or cross ties are then broken off. One drawback of all concrete walls however, is that they are poor insulators. A typical concrete wall has an insulating "R" value of approximately 1.0.

To improve the insulating qualities of concrete walls, several methods have been developed for incorporating insulation boards, such as polystyrene sheets, within the concrete wall, or, on one or both exterior surfaces of the concrete wall. A concrete wall with 2.5 inches of polystyrene insulation on one side has an insulating "R" value of approximately 13.0; whereas, a concrete wall with 2.5 inches of polystyrene insulation on both exterior surfaces of the wall has an insulating "R" value of approximately 26.0.

One method to provide such an insulated poured concrete wall is set forth in U.S. Pat. No. 4,541,211 wherein an insulation board is sandwiched between two concrete walls. The insulation board is held midway between the pair of spaced apart wall forms by a special retaining clip 36 attached to the mid-portion of the cross-ties that retains the forms together and then concrete is poured into the two vertical void regions defined between the opposite sides of the insulation board and the opposite wall forms. Retainers 54 are used to mechanically connect the insulation board to the concrete wall layers on the opposite sides of the insulation board. In U.S. Pat. No. 5,744,076, insulation panels are provided on either one or both sides of the wall during the concrete pouring process.

Elongated F-shape retaining strips that are attached to the form cross-ties are used to position the insulation panel(s) between the spaced apart opposite form walls. A similar method is taught by U.S. Pat. No. 5,987,830 but uses a different insulation retaining clip attached to the form cross ties. U.S. Pat. No. 5,992,114 teaches another method for insulating both sides of the concrete wall wherein spaced apart insulation boards are used for the form walls. In U.S. Pat. No. 6,438,917, the insulation board is provided with a groove along its vertical elongated edge that mates with retaining clips attached to the cross ties so as to position the insulation board(s) within the opposite sides of the forms and against the inner wall surface of one of the forms and/or also against the inner wall surface of the other form to thereby form a wall structure having insulation on both sides of the concrete wall. U.S. Pat. No. 6,634,148 teaches a similar method of making an insulated wall structure during the pouring operation wherein an elongated, notched T-shaped retaining strip which engages the cross-ties is utilized to position the insulation board adjacent one wall of the forms and to hold same in said position as concrete is poured into the cavity between the insulation board and the opposite wall of the form. U.S. Pat. No. 7,059,577 shows yet another method similar to the above prior art teaching wherein an elongated T-shape retainer strip is utilized to retain the insulation board in position against one wall of the form while concrete is poured into the open space between the insulation board and the opposite wall of the forms. The T-shape retainer is attached to the cross ties that connect together the spaced apart forms. US patent No. 2009/0173870 A1 describes a concrete forming apparatus with an outer form and an inner form held upright and in a spaced apart relationship via interconnecting tie rods 18. Between the inner and outer forms is a sheet of insulation 22 that's suspended along the tie rods (either centrally or offset). To stop the insulation from ripping when concrete is poured into the forms, the tie rods are passed through the insulation via a strengthening sleeve 28. Additionally, spacing rods 24 are used to keep the insulation away from the inner and outer forms and the spacing rods pass through strengthening spools 26 located perpendicularly within the insulation. U.S. Pat. No. 7,059,577 B1 patent describes an insulated concrete wall system employing inner and outer forms 12. The inner form abuts insulation panels 14, held into place and anchored to the poured concrete wall via "T" stud 16 which has a front face 26 that is visible in the finished wall and serves as a place for drywall to be anchored. The "T" studs also have an anchoring portion 30 which extends into the concrete wall beyond the insulation panels. The insulation panels, concrete forms and "T" studs are held in position via cross-ties 24 which pass between the insulation panels and through slots in the "T" stud 32. And U.S. Pat. No. 5,409,193 patent shows an apparatus and method for applying insulation to one or both sides of a poured concrete wall at the time the wall is poured. Insulation panels 12 are suspended inside the forms 22 using "F" strips 14 that affix to novel cross-ties 16 which hold the forms upright and spaced. Once the concrete is poured and cured, the cross-ties remain embedded in the body of the concrete, as do the "F" strips which hold the insulation securely against the wall. Each of the above methods includes in one way or another, specialized retainer clips that cooperate with the cross-ties. In addition thereto, each of the above methods produces a wall structure having a given-thickness concrete portion and then the insulation board(s) just adds to this given-thickness.

It is well known in the art, a concrete wall, such as a basement wall must be of a certain thickness, depending upon its vertical height, to support a predetermined load. Generally, the greater the height of the wall, the greater its thickness needed to support a predetermined load. And generally speaking, the thicker the wall, the more concrete is needed and, more concrete usually equates to more and increased costs. The above-described insulated, concrete poured walls inventions were basically directed to increasing the insulation "R" value of the poured wall, but none of them addressed the problem of the amount of concrete utilized in a given wall structure in an attempt to reduce the amount of concrete and thus the cost savings resulting therefrom.

The Zimmerman U.S. Pat. No. 4,570,398 patent, assigned to Superior Walls, introduced a new method for constructing basement walls. The key to the Zimmerman wall was the use of "precast concrete studs" for vertical height and strength. The precast studs were specifically designed to match their anticipated use. For a common residential basement wall, typically, the studs are two inches wide by six inches in depth and eight feet in height. These precast concrete studs are essentially rectangular in cross section but could contain a central narrower web to reduce weight and material cost. Steel reinforcing oriented along the length are cast into the studs to increase their strength, and several holes are formed in the central region to permit subsequent laying of electrical wires or water pipes through the studs within the walls that they form. Additionally, when the studs are cast, a pressure treated wood strip is cast onto one long, narrow edge, the edge that forms the interior basement wall, for easy attachment thereto of drywall or the like. These concrete precast studs are normally manufactured in a building, warehouse or shop and then transported to the basement site for installation. At the site, the studs are set on a base beam and spaced on two foot centers and extend vertically upward eight feet where a top wooden plate connects the concrete vertical studs together. After the stud construction is completed, the exterior walls of the basement are constructed. This begins with the attachment to the exterior of the concrete studs, one or more layers of rigid sheath insulation by pushing the sheath insulation against fasteners protruding from the concrete studs. A layer of wire mesh is then attached over the entire surface outside of the insulation, and then, concrete is sprayed onto the outer surface of the wire mesh at high velocity. The thickness of the sprayed concrete is between one to two inches thick. With the use of the precast concrete studs, the inventor was able to reduce the thickness of the concrete (maximum thickness of 2 inches) of the wall structure and at the same time increase the insulation R value of the wall structure by providing the insulation sheaths. The exterior of the wall structure would appear to be a monolithic smooth surface, whereas, the interior surface of the wall structure is stepped and offset with the plurality of spaced, six inch depth concrete studs projecting inwardly into the basement area from the insulation sheaths.

In a further improvement, rather than constructing the wall structure, with the precast concrete studs, on site, as described in the above '398 patent, Zimmerman utilized the precast concrete stud construction concept to manufacture prefabricated structural wall panels as shown and described in his U.S. Pat. Nos. 4,605,529 and 4,751,803 patents. The prefabricated wall panel is accomplished within an assembly jig which permits the wall panel to be manufactured in a horizontal position, so that conventional concrete delivery trucks can be used as a material source. Basically, in the assembly jig, spaced precast concrete studs with fasteners protruding from one edge are used to build the panel while oriented in a horizontal plane. Rigid sheet insulation is attached to the outside of the concrete studs and wire mesh is laid upon the sheet insulation. Concrete is then poured onto the insulation, the wire mesh and the protruding fasteners to form a continuous water-proof outer surface. Horizontal top and bottom beams are bonded to the concrete studs and are formed at the same time as the outer concrete surface. After setting of the concrete, the wall panel is one integral modular concrete structure which is transported on large trucks to a construction site for erection of several modules together to form the wall structure. Normally, this requires the use of a very large crane since the precast wall panels are extremely heavy. And in U.S. Pat. Nos. 4,934,121 and 5,055,252, Zimmerman describes and defines the method and means for connecting the prefabricated wall panels together at the job site. Basically, the panels are bolted together to form a rigid structure in thus forming an integral wall structure, such as the basement walls of a house. Here again, with the utilization of the precast concrete stud, the thickness of the concrete of the prefabricated panels that make up the final wall structure is considerable less than an equivalent block wall or standard poured wall. Also, we again have the same interior wall profile as in the above described '398 patented structure having a staggered offset profile with the precast concrete studs projecting inwardly further than the insulation panels. And yet another improvement to the Superior Wall prefabricated panels can be seen in U.S. Pat. No. 6,494,004 B1 (ZIMMERMAN) which shows a jig made of insulation panels that form the mold for a prefabricated concrete wall. The mold is assembled via a series of interconnecting foam panels, onto and into which concrete is poured forming the wall with integrated studs and insulation. Each stud is created using a metal channel 12 that holds three pieces of insulation in a "U" configuration, panel 16 at the base of the metal channel with panels 14 extending up along the sides. Suspended on panels 14 are panels 16 which comprise the inside surface of the concrete wall. Panels 14 and 16 are grooved to accept one another and stabilize the form during pouring. The resulting prefabricated wall has a continuous outer concrete surface with integrated studs and insulation comprising the inside of the wall; a stepped configuration.

The "Superior Wall" prefabricated panels have gained considerable market success in recent years and has many advantages and is ideally suited for certain construction projects and now there are several other companies that manufacture, sell, and erect similar such prefabricated panels, such as Titan Walls, Inc., Ideal Precast, and Specialty Precast Company. Some examples of other prior art prefabricated panels can be seen in the following: U.S. Pat. No. 5,313,753 discloses a prefabricated concrete wall 10 which consists of a continuous concrete planar face 12 integrated with studs 14 and adjacent insulation panels 16. The inner face of the studs has channels 20 housing polystyrene strips 50 for receiving drywall screws and the inner profile of the wall is planar. The wall 10 is attached to the footer via "L" brackets 32. U.S. Pat. No. 6,427,406 B1 patent teaches a preformed concrete wall that can be a cavity wall, best seen in FIG. 1, or a planar wall, best seen in FIG. 2. The concrete wall 1 has vertical studs 10 extending between a top beam 32 and a bottom beam 34, with integral studs poured into stud forms 12. The stud forms have rebar 20 that extends into the top beam and bottom beam for integration, and insulation 14 under the stud form abutting the interior face of the stud. The interior of the wall has either recessed insulation, creating a cavity wall panel as seen in FIG. 1 or thicker insulation, creating a planar wall panel as seen in FIG. 2. U.S. Pat. No. 6,338,231 B1 describes a precast concrete wall panel with a flat side 26 and a recessed side 28. The recessed side has a header 22 and footer 24, between which are horizontal ribs 32 that are vertically spaced. The recessed side is filled with insulation batts 34, which create a flat surface planar with the header and footer. The footer has a side recess 44 to accommodate rods or bars used to secure the wall panel to the foundation. The precast panels are lined up side by side to form the wall. And U.S. Pat. No. 7,530,203 B1 patent discloses a precast concrete wall system with an upper ledge that supports trusses for a below-grade floor system. The wall panel 10 is formed with a horizontal footer beam 12, an upper beam 15, and vertical concrete studs 13 extending between the two. Between the studs, the wall is insulated with a sheet of polystyrene 16. Each stud is covered with a foam "U" channel 35, which abuts the polystyrene sheets 16, creating a continuous layer of insulation on the interior of the wall. The wall described is mounted onto a bed of crushed stone.

One major disadvantage of using prefabricated panels is that for erection at the site, a large crane is required to lift and move the prefabricated panels into place and generally, these panels are set on a thin layer of compacted, crushed fine gravel which is in direct contrast to the long standing practice used for block and poured wall construction where a "concrete footing" (footer) is required for supporting the wall and the load supported by the wall. Although the prefabricated panel wall construction meets the code requirements in many areas, it is questionable over the long run whether such compacted crush stone base is equivalent to the traditional footer construction, especially in the northern areas of the country where freezing and thawing must be taken into consideration in the construction of such walls. Thus, there is a desire in the marketplace to have an insulated concrete wall structure that is constructed using the poured wall method and which wall structure is supported on a typical well-known footer and which wall structure provides a planar interior wall surface.

SUMMARY OF THE INVENTION

The present invention provides an insulated concrete wall structure designed to satisfy the aforementioned need. The wall structure of the present invention is a concrete wall poured onsite in thereby eliminating the need for large cranes and the like at the construction site as required when using prefabricated wall panels. Further, the wall structure of the present invention incorporates the use of concrete T-beam supports which are formed onsite through the use of spaced insulations panels that not only provides an insulated wall structure with a high R value factor, but in addition thereto, the use of the integral concrete T-beam supports require less concrete and thus less costly as compared to standard poured walls having the same load bearing capacity. In the preferred embodiment, the insulated wall structure is formed on a concrete footer and the upright T-beam supports are formed on the footer and the upper ends of the upright T-beam supports are integrally connected together by a concrete box beam formed onsite along with the formation of the upright T-beam supports for unitary construction. Furthermore, upright rebars extend through each of the T-beam supports and are integrally connected to the lower footer and integrally connected to the upper box beam for interconnecting the T-beam supports, the footer and the box beam in a unified structure. And still further, the use of the insulation panels in the present invention not only provides for an insulated wall structure with a high R value, but also serve as the means for forming the unitary T-beam supports and the box beam, and also additionally provides the wall structure with an inner wall completely covered with insulation panels having a relatively smooth planar surface rather than an offset, stepped interrupted surface as is the case when using prefabricated panels.

Accordingly, the present invention is directed to an insulated poured concrete wall structure formed onsite and integrally interconnected to a base, comprising (a) a plurality of concrete upright T-beam supports supported on and spaced along the base; (b) a plurality of insulation panels with each insulation panel being attached to and spanning between adjacent T-beam supports; (c) a horizontal concrete box beam spanning across upper ends of the plurality of insulation panels and across and integrally connected to upper ends of the plurality of upright T-beam supports; and (d) at least one vertically extending rebar passing through at least one of the plurality of upright T-beam supports with the lower end of the rebar projecting into and integrally connected to the base and with the upper end of the rebar projecting into and integrally connected to the box beam whereby the box beam, the plurality of T-beam supports and the base are integrally interconnected to form a unitary rigid wall structure.

More particularly, preferably the base is a concrete poured footer and includes at least one bore hole for accepting the lower end of the rebar for integrally connecting the rebar to the base during the pouring of the uncured concrete. Further, each of the T-beam supports includes a cross-leg and a middle-leg being integral with and perpendicular to the cross-leg and the plurality of middle-legs are equally spaced apart and the plurality of cross-legs are are integral with one another in thereby forming a continuous unitary outer wall of the wall structure. Still further, each of the plurality of insulation panels are rectangular in shape having opposite edge faces and opposite rear and front faces with each insulation panel spanning between adjacent T-beam supports with the opposite edge faces contacting the respective middle-leg of adjacent T-beam supports and with the rear face of each respective insulation panel contacting against the cross-leg formed by the adjacent spaced apart T-beam supports. Additionally, the wall structure includes a vertically extending C-shaped channel attached to an inward face-edge of each of the middle-legs of the plurality of T-beam supports and a second smaller insulation panel is contained within an open face of the C-shaped channel in thereby providing an inward insulation panel wall of the wall structure with a smooth planar surface.

Furthermore, the thickness of the cross-leg and the middle leg of each of the T-beam supports are substantially equal, however, the thickness of the middle-leg can be greater than the thickness of the cross-leg. The depth thickness of each of the insulation panels is at least as thick as the depth thickness of the middle-leg of the T-beam support which is perpendicularly disposed relative to the cross-leg of the T-beam support.

Still further, the present invention is also directed to a method of forming an insulated poured concrete wall structure on-site having integral concrete T-beam supports, comprising the steps of (a) erecting a pair of spaced apart inner and outer forms on a base in defining a wall cavity therebetween for receiving uncured concrete; (b) placing a series of insulation panels having opposite side edges and opposite front and rear faces into the wall cavity and positioning the insulation panels within the wall cavity such that the front face of each insulation panel abuts against an inner face of the inner form and the rear face of each insulation panel is spaced away from an inner face of the outer form in defining an outer wall cavity having a horizontal thickness and such that the respective side edges of adjacent insulation panels are spaced apart in defining a plurality of support wall cavities each being perpendicular to and integral with the outer wall cavity and each having a horizontal thickness at least as thick as the horizontal thickness of the outer wall cavity; and (c) pouring uncured concrete onsite into the outer wall cavity and the plurality of support wall cavities in thereby forming a unitary, insulated wall structure having a plurality of integral T-beam supports. Additionally, the forming method further includes providing a box beam cavity at an upper end portion of the inner and outer forms that extends above and is integral with the outer wall cavity and the support wall cavity for forming a horizontally extending box beam during the pouring of the uncured concrete such that the outer wall, the support wall and the box beam to be formed are structurally interconnected.

More particularly, for structural reinforcement at least one horizontally extending rebar is suspended within the box beam cavity prior to pouring of the uncured concrete. The rebar is supported on horizontal rebar retainers attached to the top edge of each of the series of spaced apart insulation panels. And for structural integrity, a series of aligned spaced apart holes are provided in the base and at least one vertically extending rebar is suspended within at least one of the pluralities of support wall cavities with one end of the rebar being disposed within the box beam cavity and the other end of the rebar is disposed within one of the spaced apart holes provided in the base. Preferably, each of the support wall cavities includes a rebar that has one end projecting into the box beam cavity and the opposite end inserted in one of the holes in the base so as to structurally interconnect the box beam and the T-beam supports, to be formed during the concrete pouring operation, to the base. The vertically extending rebars are suspended in the support wall cavities by supporting the upper ends of the rebars in a retainer attached to upper ends of adjacent insulation panels whereas the lower ends of the rebars are retained in the holes provided in the base. The series of insulation panels are aligned along the inner surface of the inner form and are spaced away from the inner surface of the outer form by wall spacers extending between the outer wall form and the rear face of the insulation panels and the series of aligned insulation panels are equally spaced apart by spacers extending between adjacent panels during the positioning of the panels within the wall cavity. And additionally, a vertically extending C-shaped channel is positioned within each of the plurality of support wall cavities and located between the side edges of adjacent insulation panels for retaining a small insulation panel therewithin such that the interior surface of the wall structure is completely covered with insulation material which presents a relatively continuous, non-interrupted planar surface.

These and other features and advantages of the present invention will become apparent to those skilled in the art upon a reading of the following detailed description when taken in conjunction with the drawings wherein there is shown and described an illustrative embodiment(s) of the invention.

BRIEF DESCRIPTION OF THE DRAWINGS

In the course of the following detailed description, reference will be made to the attached drawings in which:

FIG. 12 is an elevational view, on an enlarged scale, of a single rebar retainer for retaining the upper end of a vertical extending rebar disposed within the support wall cavity.

FIG. 13 is a plan view of the single rebar retainer as seen along line 13-13 of FIG. 12.

FIG. 14 is an elevational view of a double rebar retainer for supporting a pair of rebars in the box-beam cavity in the upper portion of the forms.

FIG. 15 is a plan view of the double rebar retainer as seen along line 15-15 of FIG. 14.

FIG. 16 is a plan view of a channel member that is disposed between the opposite side edges of adjacent insulation panels within the support wall cavity.

FIG. 17 is a partial, elevational view of the channel member as seen along line 17-17 of FIG. 16.

FIG. 24 is a plan view of an L-shape standard footer on which the subject wall structure will be constructed and showing spaced single rebar bores or holes spaced along each leg of the footer and with a corner form positioned on the corner of the footer.

FIG. 25 is an elevational view of one end of the corner form shown in FIG. 24 showing cross-ties connecting the inner and outer forms together.

FIG. 26 is a plan view similar to the view seen in FIG. 24 with the addition of a first form section being positioned on the footer and being connected in abutting relationship to one leg of the corner form.

DETAILED DESCRIPTION OF THE PREFERRED EMBODIMENT

Figure 1:
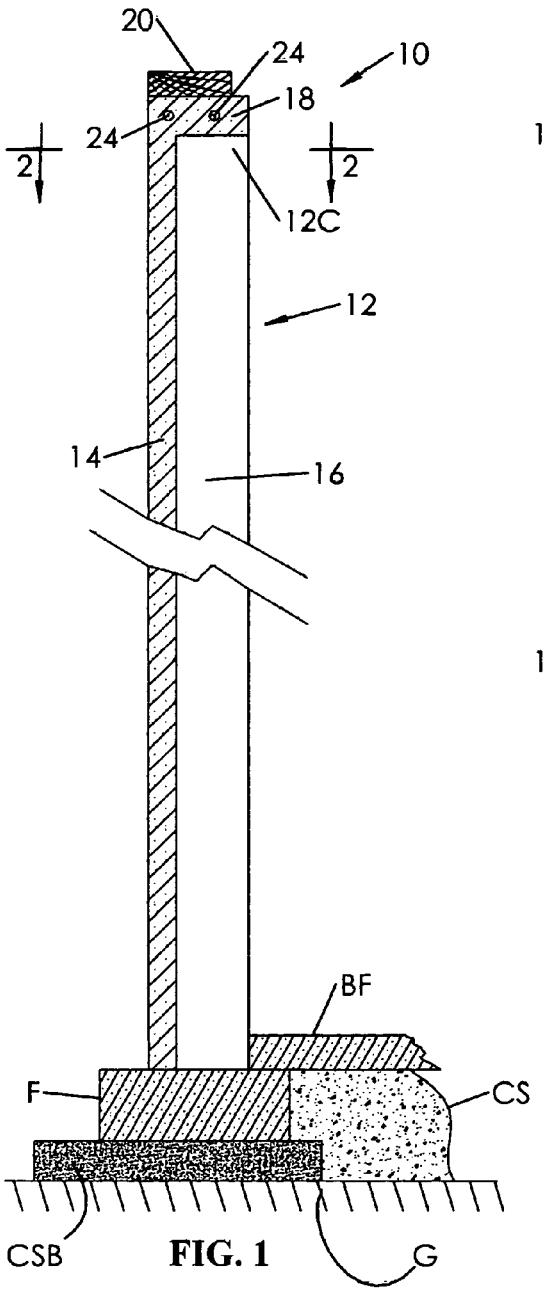
FIG. 1 is a sectional, side elevation view, taken along line 1-1 of FIG. 2, of the wall structure formed in accordance with the principles of the subject invention.

In the following description, like reference characters designate like or corresponding parts throughout the several views of the drawings. Also in the following description, it is to be understood that such terms as "forward", "rearward", "left", "right", "upwardly", "downwardly", and the like are words of convenience and are not to be construed as limiting terms.

Referring now to the drawings, and particularly to FIGS. 1-4, there is shown the preferred embodiment of the insulated poured concrete wall structure with integral T-beam supports constructed in accordance with the principles of the subject invention. The wall structure, generally designated by the numeral 10, has been depicted in the drawings as a basement wall; however, the wall structure 10 can be used in various building structures as well recognized by those skilled in the art. The wall structure 10 is constructed upon and supported by a typical reinforced, concrete footing, commonly referred to as footer F that is supported on a compacted crush-stone base CSB that rest on the ground G. After all of the walls of the basement have been constructed in accordance with the subject invention, a basement floor BF is then poured on crushed stone CS in a conventional manner.

Basically, the wall structure 10 includes a plurality of upright T-beam supports 12 integrally attached to and spaced along the footer F with each T-beam support 12 having a cross-leg 12A and a middle leg 12B and with said cross-legs 12A being integrally connected to form a continuous outer wall 14; a plurality of insulation panels 16 integrally attached to and spanning between the spaced apart T-beam supports 12; and a box beam 18 spanning across and integrally connecting the upper ends 12C of the upright T-beam supports 12 in thereby forming an integral, insulated wall structure.

Figure 3:
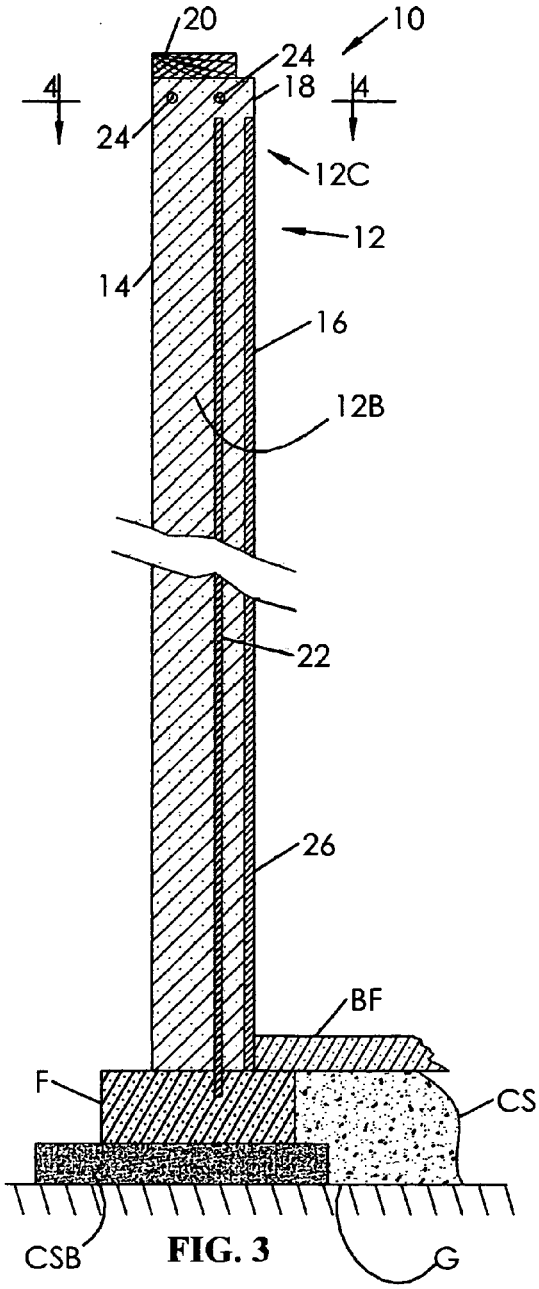
FIG. 3 is view similar to FIG. 1, being a sectional side elevation view of the wall structure with the section being taken through a T-beam support as seen along line 3-3 of FIG. 4 showing the vertical rebar extending into the footer.

For illustrational purposes only, the wall structure 10, as depicted in the drawings, has been specifically designed for a basement wall having a height of approximately nine feet. For a clearer understanding of the wall structure, as well as for the method for forming the wall structure, specific dimensions are given, however, said dimensions are not to be considered as limiting in anyway. Typically, a nine foot (9.0') high, uninsulated basement wall of cinder block or poured concrete has a continuous thickness of approximately eight to ten inches (8.0-10.0") depending upon the amount of reinforcement bars utilized. In the subject invention, for an equivalent load bearing basement wall, the wall structure 10 has reinforced concrete T-beam supports 12 spaced on two foot (2.0') centers along the footer F with the cross-legs 12A having a horizontal thickness of approximately two and one-half inches (2.5") such that the outer concrete wall 14 of the wall structure 12, which is formed by the cross-legs 12A, is also two and one-half inches (2.5") in thickness and with the middle-legs 12B of the T-beam supports 12 having a thickness of about three inches (3.0") and a depth of about six inches (6.0"). The wall structure 10 further includes the reinforced, concrete box-beam 18 that spans across and integrally connects the upper ends 12C of the upright T-beam supports 12. The box-beam 18*t* has a vertical height of approximately three and one-half inches (3.5") and a depth dimension of approximately nine and a half inches (9.5"), as measured in a horizontal direction as seen in FIGS. 1 and 3. As can be appreciated from the dimensions set forth above, the amount of concrete utilized in constructing the subject wall structure 10 is considerably less than the amount of concrete needed to construct an equivalent load bearing, typical block or poured concrete wall. Less concrete used, generally equates to less costs. And there is no requirement for use of a large crane at the construction site for the erection of heavy prefabricated panels such as is the case in the Superior Wall structure. Also seen in FIGS. 1 and 3 is a conventional top plate 20, usually made of wood, attached to and extending along the top of the concrete box-beam 18 for attaching floor joists in the conventional building construction manner.

Figure 2:
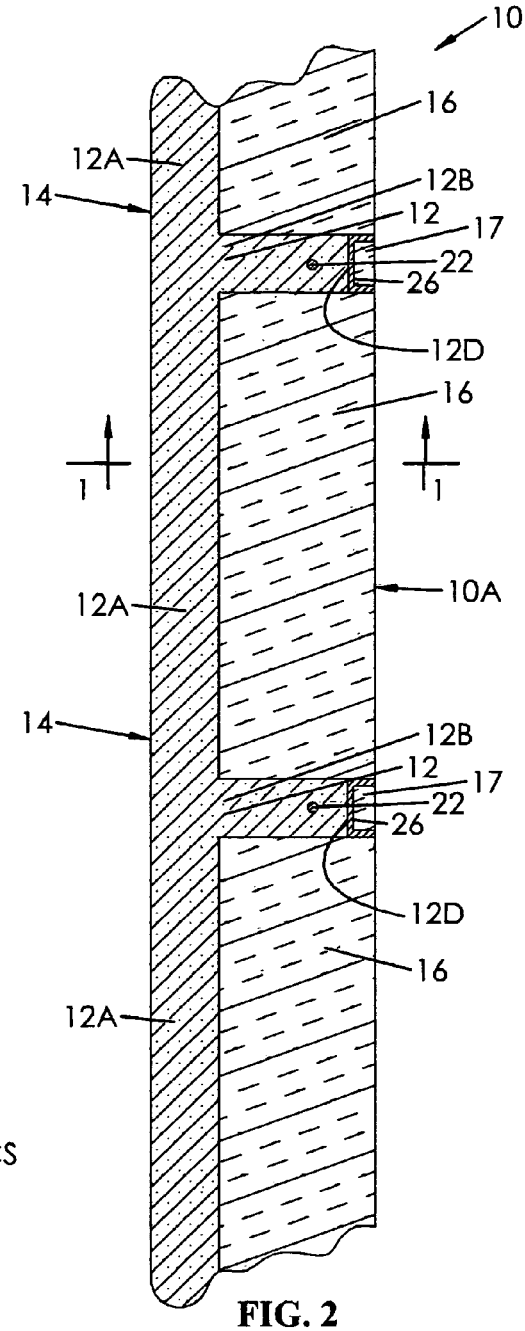
FIG. 2 is a partial sectional view, on an enlarged scale, taken along lines 2-2 of FIG. 1 showing the poured T-beam concrete supports, the integral exterior concrete wall, and the insulation panels extending between the T-beam supports and on the inside face of the concrete wall.
Figure 4:
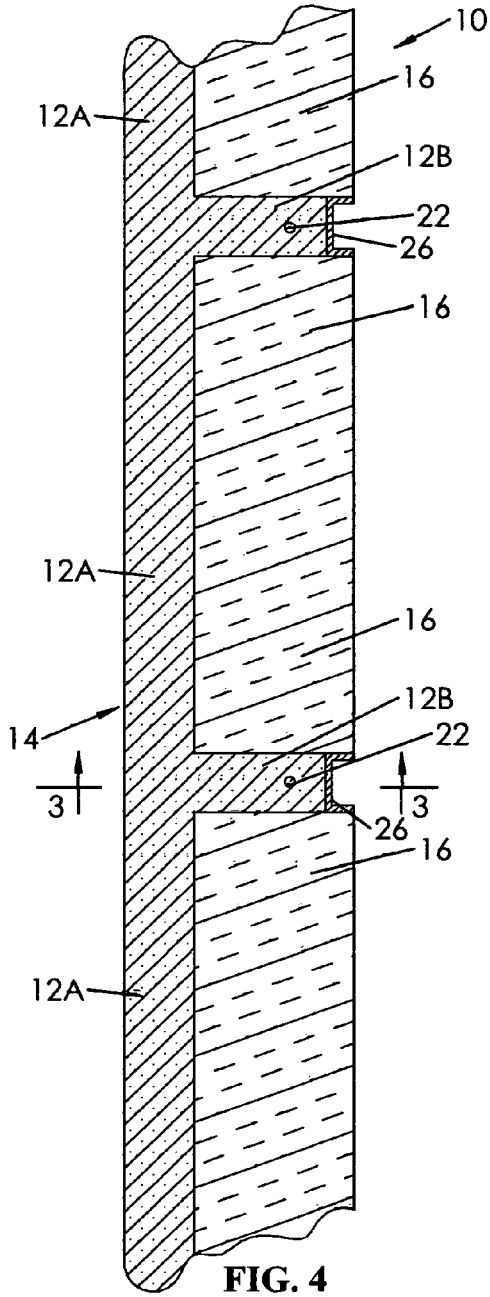
FIG. 4, is a view similar to FIG. 2, taken along line 4-4 of FIG. 3 showing a T-beam support with a channel on the inward edge of the support and having a reinforcing bar (rebar) extending up through the support.

Still referring to FIGS. 1-4, the insulation panels 16 of the wall structure 10 are approximately twenty one inches (21.0") in width, to fit between the adjacent spaced apart middle-legs of the T-beam supports 12, are of a height of approximately eight feet (8.0°) and eight and one half inches (8.5"), and preferably are seven inches (7.0") in depth or horizontal thickness. The insulation panels are relatively rigid and can be made of expanded polystyrene, foam or any other suitable such material that is on the market. Although the insulation panels are shown and described as being of a one-piece construction, there can be multi-piece with one piece stacked on top of the other. As best seen in FIGS. 2, 3, and 4, each of the upright T-beam supports 12 includes a single elongated rebar 22 located in the central portion of the middle leg 12B extending from within the lower footer F, up through the T-beam support 12 and up into the upper box-beam 18 to provide added strength to the wall structure 10. And in like fashion, as best seen in FIGS. 1 and 3, the box-beam 18 is provided with a pair of spaced apart rebar's 24 that extend horizontally, through and along the box-beam 18.

In the preferred embodiment, the wall structure 10 further includes a C-shape metal channel 26 disposed along the inner face 12D of each of the upright T-beam supports 12, as best seen in FIGS. 2 and 4, and integrally attached thereto during the concrete pouring operation which will be described in further detail below. The elongated channel 26 is approximately nine foot (9.0°) in height, three inches (3.0") in width, and with each leg of the channel being one inch (1.0") in depth. The channel 26 is spaced between adjacent insulation panels 16. The purpose of channels 26 is to facilitate the attachment thereto of an interior basement wall covering, such as drywall where screws can be screwed into the metal channel rather than into a hard concrete wall. Alternatively, rather than using a metal channel member, such as channel 26, a wood stud (not shown) could be substituted therefor to facilitate the attachment of drywall to the interior wall of the wall structure 10. With the preferred use of the channels 26, the thickness of the insulation panels is approximately seven inches (7.0") in thereby projecting inwardly beyond the inner face 12D of the upright T-beam supports 12 about one inch (1.0"), and thus flush with the outer edge of the legs of the channels 26. Accordingly, in the illustrative embodiment, the depth of the middle leg 12B of supports 12 is approximately six inches (6.0"), the depth of the channel 26 is approximately one inch (1.0"), and the depth thickness of the insulation panels 16 is approximately seven inches (7.0"). Once the wall structure 10 has been completed, which will be described in complete detail below, a three inch (3.0") wide by one inch (1.0") thick smaller insulation panel 17 will be press fit into each of the channels 26, as best seen in FIG. 2. With the construction just described, the inward face 10A of wall structure 10 provides a smooth planar surface composed of aligned insulation panels rather than a stepped, offset interior surface provided by the prior art prefabricated panel construction.

Figure 5:
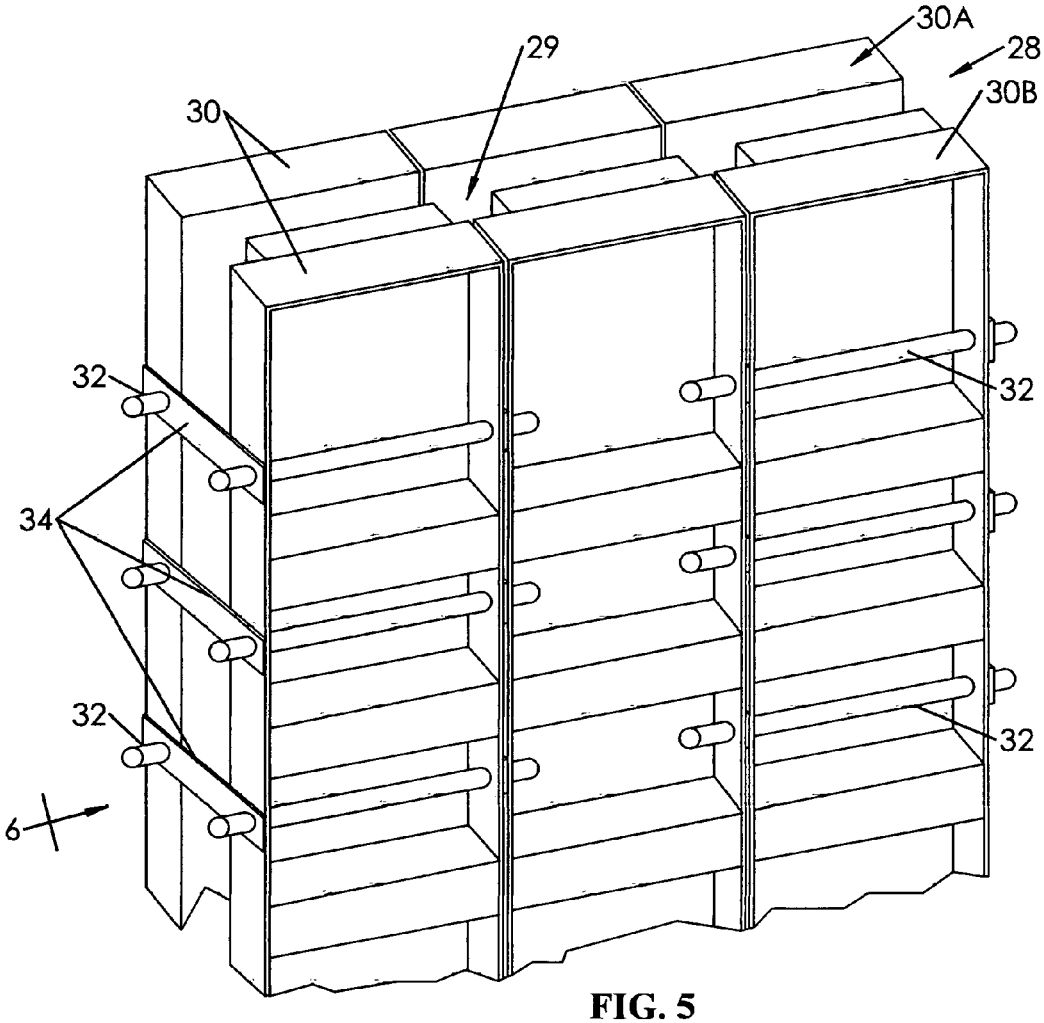
FIG. 5 is a diagrammatic perspective view of a conventional concrete wall metal form having inner and outer aligned form members facing one another and being spaced apart and with the side edges of the respective inner and outer form members connected together by conventional cross-ties and showing insulation panels disposed between the form members and so spaced from one another to define cavities that form the T-beam supports during the concrete pouring operation.
Figure 6:
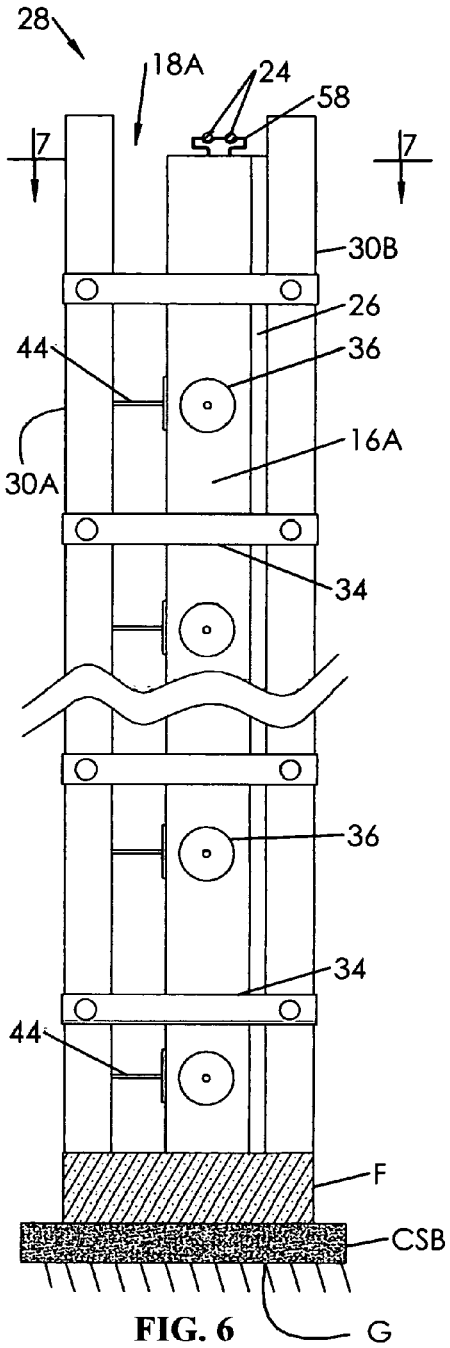
FIG. 6 is an end elevational view, as taken along line 6-6 of FIG. 7, of the pair of spaced apart forms sitting on a conventional footer with the forms being connected by cross-ties and with a insulation panel disposed between the forms and so positioned to abut against the inner form and being spaced away from the outer form by a spacer.

In FIG. 5, there is shown a perspective view of a portion of a poured wall forming system 28, embodying the present invention, for constructing the wall system 10 described above. The system 28 includes a plurality of wall forms 30 which are arranged to form two series of coplanar wall forms held in opposing spaced-apart, parallel relationship in defining a wall cavity 29 therebetween. Adjacent wall forms 30 are held in a coplanar relationship by connecting pins 32, and the two series of coplanar wall forms are held in opposing spaced apart parallel relationship by cross-ties 34. The wall forms 30, connecting pins 32 and cross-ties 34 are all conventional and well known in the art. The wall forms 30 are typically from about two to six feet (2.0' to 6.0') wide and from about two to about 9 feet (2.0' to 9.0') high and may be constructed of wood, aluminum, iron, steel, or various other materials or combinations thereof. For simplicity, the cross-ties 34 are merely shown as being rectangular plates, but can take on various shapes and configurations as well known in the art. Further, as well known, the cross-ties 34 normally extend beyond the outer edges of the forms 30 and once the concrete has been poured and cured and the forms removed, the extended ends of the cross-ties are just snapped or broken off. The forming system 28 also includes the use of dumbbell spacers 36; single ring spacers 44; single rebar retainers 52; double rebar retainers 58; and channels 18 which are shown in detail in FIGS. 8-17. The spacers 36, 44; the retainers 52, 58; and the channels 18 are merely illustrative of one type of spacers, retainers and channels that can be used in the forming system 28 to provide their specific function; however, as can be appreciated by those skilled in the art and in accordance with the principles of the subject invention, these spacers, retainers and channels can take on various other shapes and forms and thus are not limiting.

Figure 8:
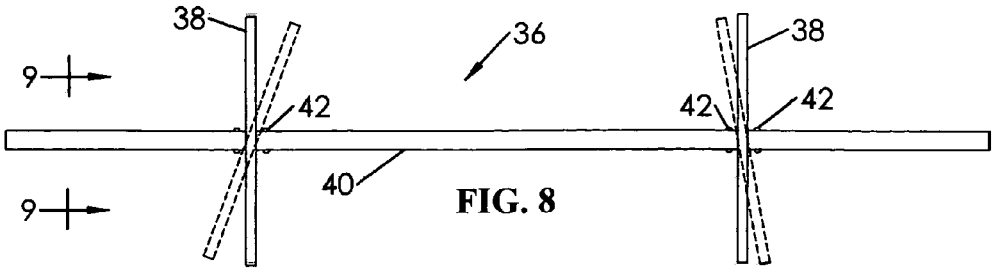
FIG. 8 is a plan view, on an enlarged scale, of a dumbbell spacer used in the subject invention to maintain the spacing distance between the opposite side edges of adjacent insulation panels which defines the support cavity therebetween that forms the middle leg of the T-beam support when uncured concrete is poured into the forms.
Figure 9:
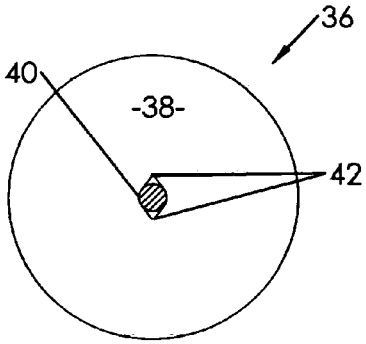
FIG. 9 is a sectional view taken along line 9-9 of FIG. 8.
Figure 11:
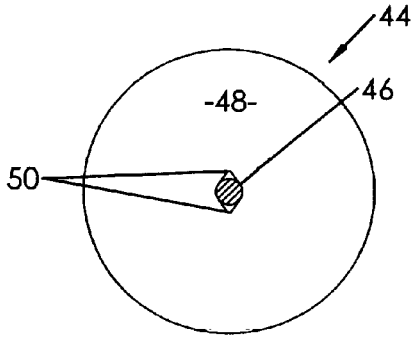
FIG. 11 is a sectional view taken along line 11-11 of FIG. 10.
Figure 10:
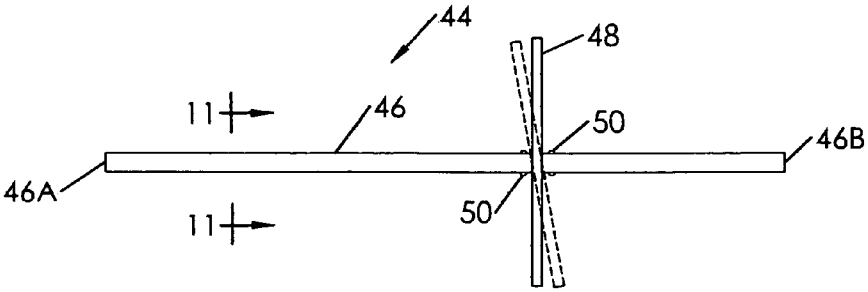
FIG. 10 is a plan view of a single ring spacer, on an enlarged scale, used in the subject invention to maintain the spacing distance between the rear face of the insulation panels and the inner surface of outer form so as to define a wall cavity therebetween that forms the cross leg of the T-beam support when uncured concrete is poured into the forms.
Figure 22:
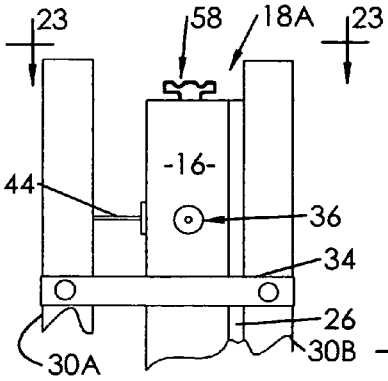
FIG. 22 is a partial, elevational view, as seen along line 22-22 of FIG. 21, showing an end view of the spaced forms with the double rebar retainer attached on the top of one of the insulation panels.

With particular reference to FIGS. 8 and 9, each dumbbell spacer 36 is comprised of a pair of discs 38 mounted on and spaced along an elongated rod 40. The spacing between the discs 38 on rod 40 is about the same distance as the depth of the middle leg 12B of the upright T-beam support 12 and the discs 38 are mounted by a pair of crimps 42 on rod 40 on opposite sides of each disc 38 so that the discs 38 can flexibly move about rod 40 such as shown by the dotted line positions seen in FIG. 8. With particular reference to FIGS. 10 and 11, each single disc retainer 44 is comprised of an elongated rod 46 having opposite ends 46A and 46B with a single disc 48 mounted on rod 46 between the opposite ends 46A, 46B thereof and located toward the one end 46B. The disc 48 is mounted on rod 46 in the same fashion as the mounting of discs 38 on rod 40 with a pair of crimps 50 on opposite sides of the disc 48 so that the disc 48 is able to flex about rod 46 such as shown by the dotted line positions seen in FIG. 10. The distance between the end 46A of rod 46 and disc 48 is approximately the same dimension as the thickness of the outer wall 14 (best seen in FIG. 1) which is formed by the cross legs 12A of the upright T-beam supports 12 during the concrete forming operation. With particular reference to FIGS. 12 and 13, each single rebar retainer 52 is comprised of an elongated rod 54 having its opposite ends 54A, 54B bent perpendicularly, inwardly in the same direction, relative to the straight portion 54C of rod 54 and with a single loop 56 formed in the straight portion 54C midway between the opposite ends 54A, 54B thereof for supporting a single rebar (not shown) during the concrete forming operation. With particular reference to FIGS. 14 and 15, each double rebar retainer 58 is comprised of a rod 60 having opposite ends 60A, 60B which has been bent and so shaped to form between the opposite ends 60A, 60B a pair of spaced apart half-loops 62 that support therewithin a pair of rebars (not shown) during the concrete forming operation. And with particular reference to FIGS. 16 and 17, channels 26, which have been discussed and described above, are shown in further detail. Each elongated channel 26 includes a series of spaced apart protrusions 26A extending along its length and projecting outwardly away from the bight portion of the channel 26. During the concrete pouring operation, the protrusions 26A extend within the cavity that forms the middle legs 12B of the upright T-beam supports 12 and thus after the concrete has been poured in the cavity and then cured, the protrusions 26A serve to integrally attach the channels 26 to the upright T-beam supports 12.

In General—Wall Structure Construction

Referring again to FIG. 5 and also with particular reference to FIGS. 6 and 7 and FIGS. 18-23, the construction of wall structure 10 will now be described in further detail. Wall structure 10 is constructed at the job site by the poured concrete wall forming system 28 described above and basically includes the erecting of a plurality of wall forms 30 upon a previously poured and cured concrete footer F. Forms 30 are arranged to form two series of coplanar wall forms (referred to hereinafter as outer form 30A and inner form 30B) held in opposing spaced-apart, parallel relationship with the adjacent respective wall forms 30A, 30B held in a coplanar relationship by connecting pins 32 and held in opposing spaced apart parallel relationship by cross-ties 34. The spaced apart wall forms 30A, 30B define therebetween a wall cavity 29.

Figure 7:
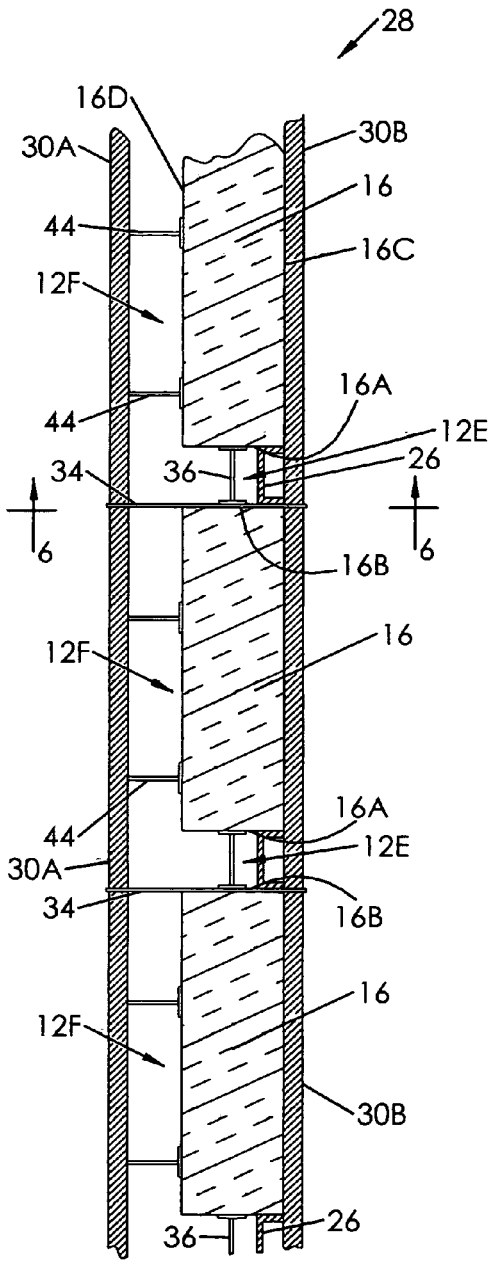
FIG. 7 is a sectional view taken along line 7-7 of FIG. 6 showing the spaced apart forms, the insulation panels disposed between the forms and with each insulation panel being positioned against the inner form and being spaced from one another to define the cavity that forms the middle leg of the T-beam support and being positioned away from the outer form, by a spacer, to define the cavity that forms the cross-leg of the T-beam support when uncured concrete is poured into the forms.
Figure 18:
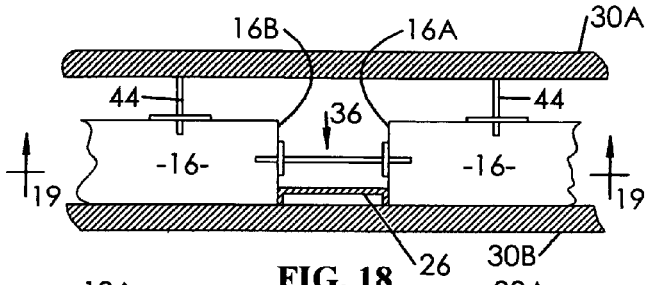
FIG. 18 is a partial sectional, top plan view looking down at the space-apart forms, as seen from line 18-18 of FIG. 19, with two insulation panels being disposed within the inner and outer forms and arranged in a spaced apart relationship and abutting against the inner surface of the inner form and spaced away from the inner surface of the outer form.
Figure 19:
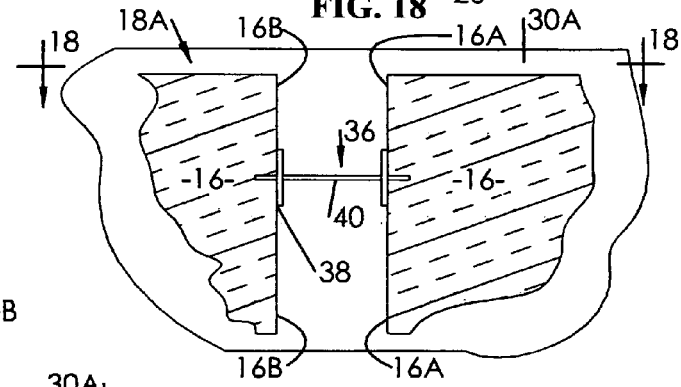
FIG. 19 is a partial sectional, elevational view taken along line 19-19 of FIG. 18.
Figure 23:
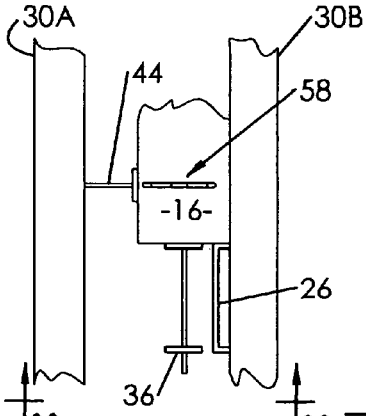
FIG. 23 is a plan sectional view, taken along line 23-23 of FIG. 22, showing the insulation panel positioned against the inner surface of the inner form and spaced away from the inner surface of the outer form and with the cross-tie seen in FIG. 22 being removed to more clearly show the channel and the spacer on the side edge of the insulation panel.

Disposed within and between wall forms 30A, 30B are a plurality or series of spaced apart insulation panels 16 aligned in a parallel relationship with their respective opposite side edges 16A, 16B facing toward one another and so oriented such that the inner front face 16C of each insulation panel 16 rests in an abutting relationship against the inner surface of the inner form 30B and with the outer rear face 16D being spaced inwardly away from the inner surface of the outer form 30A, as best shown in FIG. 7. The insulation panels 16 are held in their aligned, spaced-apart relationship by the dumbbell spacers 36 (FIGS. 8 & 9) and are held in their spaced relationship from the outer form 30A and against the inner form 30B by the single ring spacers 44 (FIGS. 10 & 11). As more clearly seen in FIGS. 18, 19, one end of the dumbbell spacer 36 is inserted or punched into one side face 16A of one insulation panel 16 whereas the opposite end of the dumbbell spacer 36 is inserted or punched into an opposite side face 16B of an adjacent insulation panel 16. The ends of the spacers 36 are inserted into the respective side faces 16A, 16B and along rod 40 up to the opposite spaced apart discs 38 so as to maintain adjacent panels 16 in a relatively firm spaced-apart relationship during the concrete pouring operation. This spaced-apart relationship defines a support wall cavity 12E between adjacent panels 16 which forms the middle-leg 12B of the upright T-beam supports 12 during the concrete pouring operation. The exact number and location of the dumbbell spacers 36 between adjacent insulation panels 16 is not critical and depends upon the spacer itself, the height of the wall to be constructed and the specific material of the insulation panel; however, it is suggested that about three such spacers be used on a nine foot high wall and that these spacers be spaced along the centerline of the side edge face of the insulation panel and be positioned in the top, middle and bottom portions of the insulation panel. The single disc spacers 44 maintain the insulation panels 16 against the inner form 30B and in their spaced relationship from the outer form 30A in thereby defining an outer wall cavity 12F between the panels 16 and the outer form 30A which forms the cross-leg 12A of the upright T-beam supports 12 during the concrete pouring operation. Still referring to FIGS. 18 & 19, one end 46B of spacer 44 is inserted into the rear outer face 16D of insulation panels 16, along rod 46 and up to disc 48, whereas the opposite end 46A of spacer 44 abuts against the outer form 30A. Again, as like spacers 36, the number and specific location of spacers 44 are not critical and it is suggested that one or two such spacers be located at the upper and lower portions of each of the insulation panels 16 for a nine foot high wall. And disposed between each of the adjacent spaced apart insulation panels 16 is the channel 26 (FIGS. 16 and 17) with the open face facing toward the inner form 30B and with the front edge of each of the opposite legs of channel 26 abutting against the inner form 30B, as best shown in FIG. 18. The insulation panels 16 are shorter in height than the height of forms 30A, 30B and the cavity area between the top of the insulation panels 16 and the top of the forms 30A, 30B is referred to hereinafter as the box-beam cavity 18A which will be described in further detail below. It should also be noted that each of the support wall cavities 12E which form the middle leg 12B of the upright T-beam supports 12 is generally perpendicular to and integral with the outer wall cavity 12F that form the cross-leg 12A of the upright T-beam supports 12. Furthermore, the horizontal thickness of the support wall cavity 12E is at least as thick as the horizontal thickness of the outer wall cavity 12F.

Figure 20:
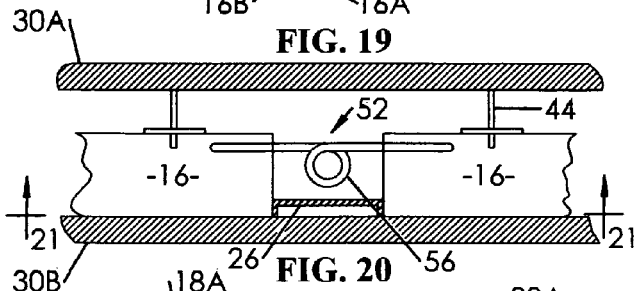
FIG. 20 is a partial, plan view, taken along line 20-20 of FIG. 21, looking down at the spaced-apart forms showing the single rebar retainer disposed across the support wall cavity defined by the space between adjacent insulation panels.
Figure 21:
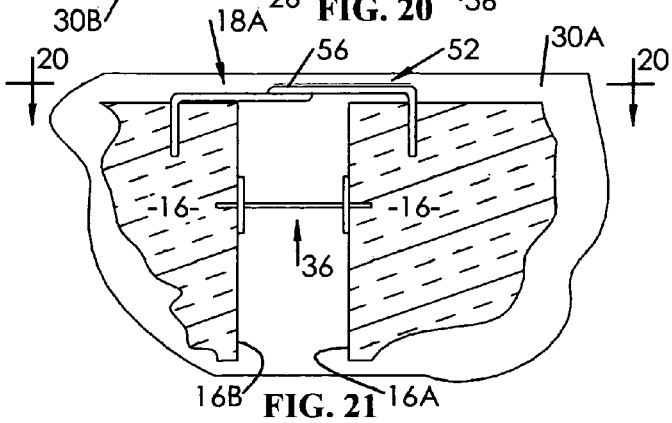
FIG. 21 is a partial, elevational view, as seen along line 21-21 of FIG. 20, showing the single rebar retainer attached to the top edge face of a pair of adjacent insulation panels and disposed across the support wall cavity for supporting the upper end of a vertically extending rebar.

After the insulations panels 16 have been installed in the forms 30A, 30B, as explained above and before the concrete pouring operation, a single rebar retainer 52 (FIGS. 12 and 13) is installed on the top surface of each pair of adjacent, spaced-apart panels 16, as best seen in FIGS. 20 and 21. Installation is performed by inserting the opposite ends 54A, 54B of the retainers 52 into the top surface of respective top end portions of adjacent panels 16 such that the straight portion 54C of each retainer 52 rest across the top surface of each pair of adjacent panels 16 with the loop 56 being disposed midway between the opposite edges of each adjacent pair of panels 16 as shown in FIG. 20. The loop 56 of retainer 52 supports the upper end of the single rebar 22 that extends upwardly from within the footer F, up through support wall cavity 12E which forms the cross-leg 12B of upright T-beam supports 12, and up to the upper area between the upper ends of forms 30A, 30B which defines the cavity 18A of the box beam 18 that extends along and across the upper end of wall structure 10 during the concrete pouring operation (see FIGS. 6, 19, 21 and 22). Also, in the preferred embodiment, the double rebar retainer 58 (FIGS. 14 and 15) is installed in the box beam cavity 18A on the top surface of each insulation panel 16 as shown on FIGS. 22 and 23. The retainer 58 is installed by inserting the opposite ends 60A, 60B thereof into the top surface of the insulation panel 16 until the bent portion of the retainer abuts the panel 16. Each one of the double rebar 22 is respectively positioned in the corresponding half-loops 62 of retainer 58 prior to the concrete pouring operation and is used for reinforcement of the box-beam 18 in a conventional manner.

Method for Forming Wall Structure

Now referring specifically to FIGS. 24-32, the steps involved in the poured concrete wall forming system 28 for constructing the wall structure 10, in accordance with the principles of the present invention, will now be discussed in further detail.

As stated before, the wall structure 10 is constructed at the job site with the use of pouring forms 30 that are erected upon concrete footer F which have been previously formed and the concrete has been cured. One of the first steps to be completed before erecting the forms is to bore or drill holes 22A in the footer F. The holes 22A are of a predetermined depth, and are spaced apart along the footer F a pre-calculated distance from one another so as to be positioned in the mid-portion of the middle-leg 12B of the upright T-beam supports 12 so as to accept the lower end of the single rebar 22 that extends upwardly therefrom, through the T-beam support 12, and up into the box beam 18, see FIG. 3. Once the drill holes 22A have been established, a corner form C is erected on the corner of the footer F as shown in FIG. 24. The corner form C is similar to form 30 having outer and inner wall sections CA and CB but of a different width dimension. In the illustrative embodiment and to be consistent with the other dimensions given above for the sole purpose of illustration, the outer wall CA has a width of fourteen inches (14.0") and the inner wall CB has a width of four inches (4.0"). The corner form C is erected on the corner of footer F and the outer and inner walls CA, CB thereof are connected together by cross-ties 34 as shown in FIG. 25.

Once the corner form C is so erected, corresponding sections of form 30, with outer and inner walls 30A, 30B, are added sequentially to the open ends of the corner form C with the outer and inner walls 30A, 30B being connected by connecting pins 32 to the corresponding outer and inner corner walls CA, CB so as to build the wall structure 10 on and along the footer F. For illustration, the sequence of steps will be described in detail for building only a portion of the wall structure along one corner opening of the corner form C and it should be easily appreciated by those skilled in the art that this sequence of steps will be repeated until all adjoining walls of the basement are completed. It should also be pointed out in this illustrative example, the wall structure 10 is for a rectangular basement and each of the four corners of the basement are of solid concrete construction as provided for by corner forms C; however, other constructions are possible for the corners, for example the corners could be constructed in an insulated wall fashion similar to the wall structure 10 of the present invention.

Figures 27, 28, 29, 30:
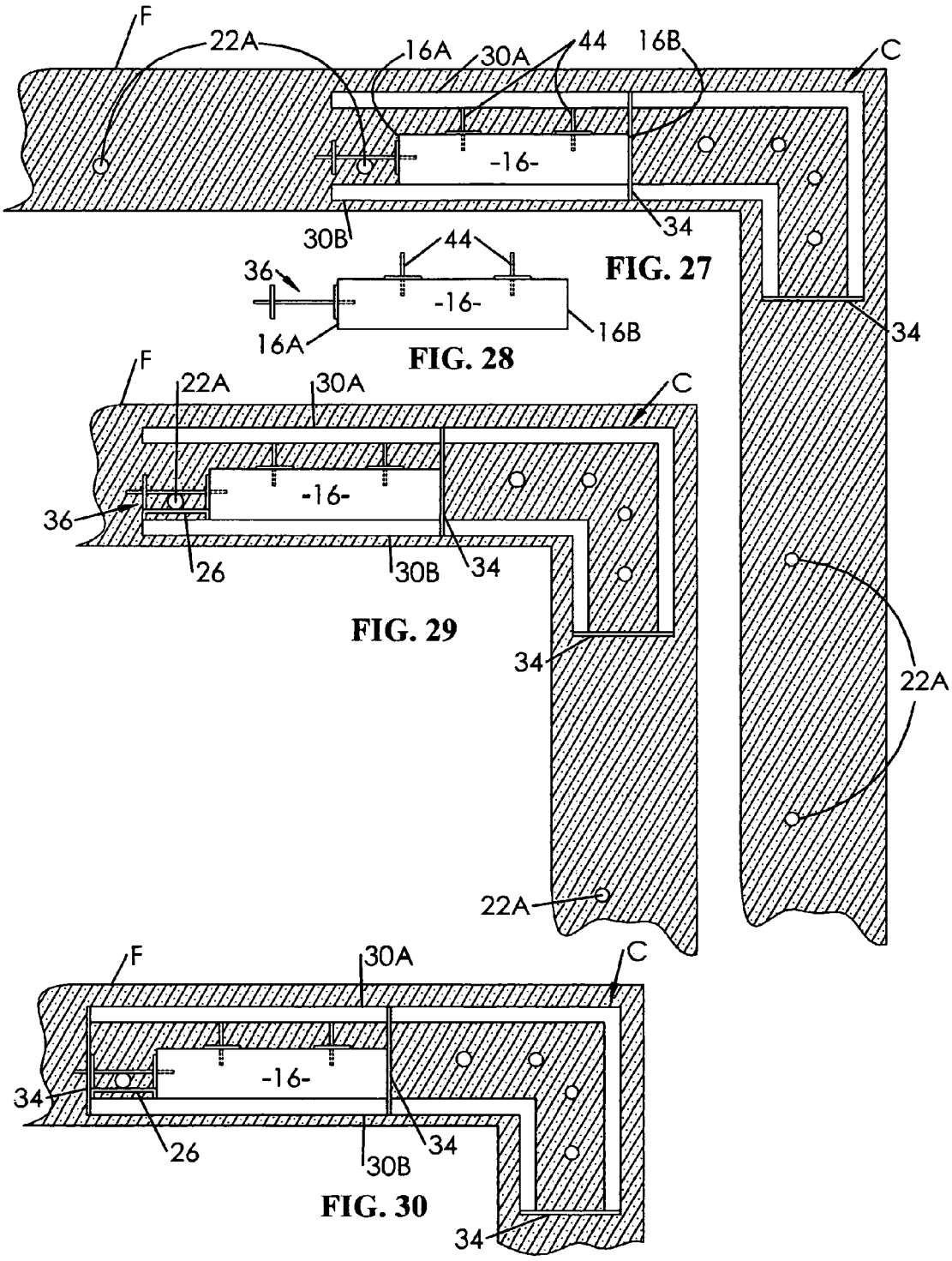
FIG. 27 is a plan view similar to FIG. 26 with the addition of a first insulation panel being inserted between the spaced walls of the first form section and being positioned therewithin such that the first side edge of the insulation panel abuts against the cross-ties on the corner form and the inner face of the insulation panel abuts against the inner surface of the inner form and spaced away from the inner surface of the outer form by the single ring spacers.
FIG. 28 shows the first insulation panel before it is inserted into the first form section as seen in FIG. 27 with the single ring spacers projecting outwardly from the outer rear face of the panel and with the dumbbell spacers projecting outwardly from the second side edge of the insulation panel.
FIG. 29 is a plan view identical to FIG. 27 but with the addition of the channel member inserted adjacent the second side edge of the insulation panel.
FIG. 30 is identical to FIG. 29 but with the addition of the cross-ties connecting the outer and inner forms together.

After the holes 22A are drilled in footer F and the corner form C erected as shown in FIG. 24, a first section of form 30 is connected at one end thereof, by connecting pins 32, to the one open end of corner form C such as shown in FIG. 26. An insulation panel 16, such as seen in FIG. 28, having the dumbbell spacers 36 mounted on one edge face 16A and with the single ring spacers 44 mounted on the rear face of the panel 16, is inserted into the wall cavity 29 defined between the outer and inner walls 30A, 30B of said first section of form 30 as shown in FIG. 27. The opposite edge face 16B of panel 16 is positioned to abut against the cross-ties 34 on said open end of the corner form C. With the use of the single ring spacers 44, the panel 16 is so positioned within outer and inner form walls 30A, 30B such that the front face of panel 16 abuts against the inner surface of inner wall 30B and with the rear face of panel 16 being spaced away from the inner surface of the outer form 30A in thereby defining the outer wall cavity 12F therebetween. As best seen in FIG. 29, channel 26 is then inserted between the outer and inner wall forms 30A, 30B of the first section of form 30 and so oriented such that one side edge of channel 26 abuts against said one side edge 16A of panel 16, with the bight portion of channel 26 facing toward the outer wall 30A, and with the front open face of channel 26 facing toward the inner form 30B and the legs of channel 26 abutting against the inner surface of inner wall 30B. As shown in FIG. 30, the opposite ends of the outer and inner walls 30A, 30B of the first section of form 30 are then connected together by cross-ties 34. The cross-ties 34 force the channel 26 against the side edge 16A of the first panel 16 in a bias mode so as to maintain the channel 26 in a relatively firm upright position as shown.

Figure 31:
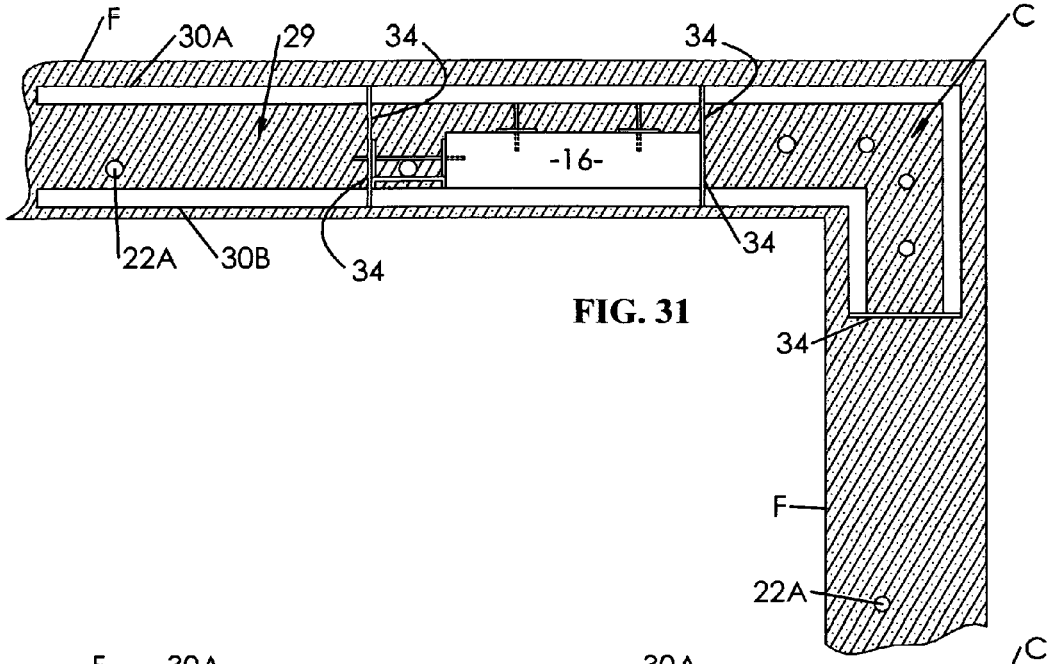
FIG. 31 is similar to FIG. 30 but with the addition of a second form section being positioned on the footer and being connected in abutting relationship to the first form section.
Figure 32:
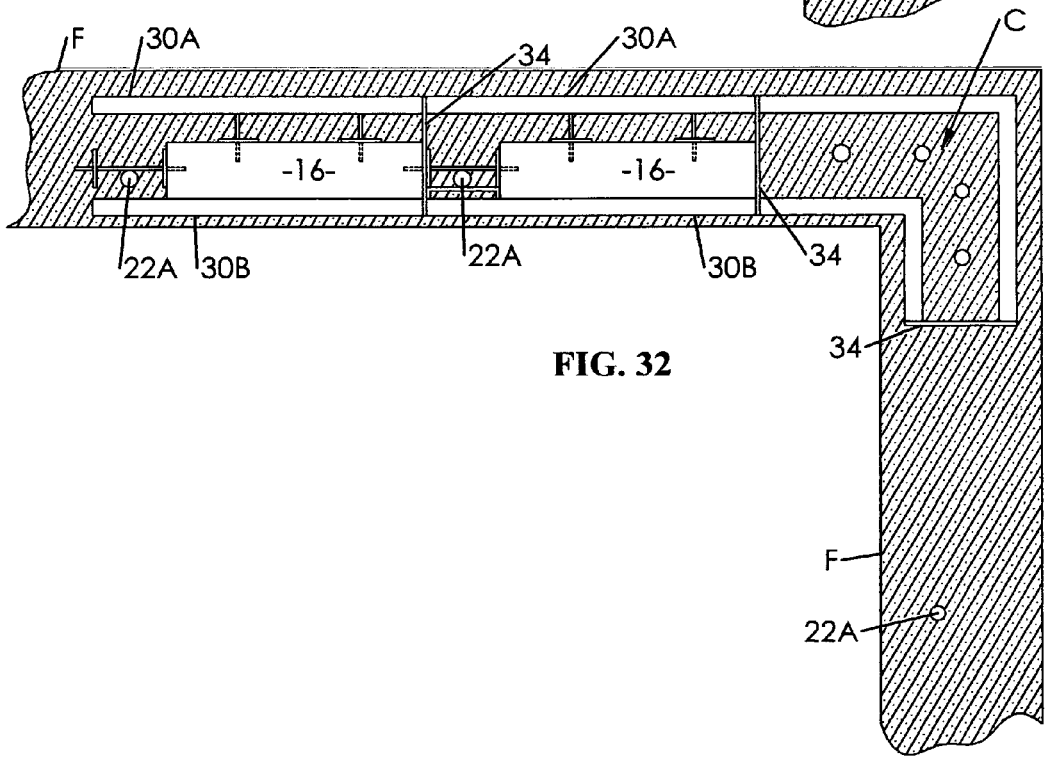
FIG. 32 is similar to FIG. 31 but with the addition of a second insulation panel having dumbbell and single ring spacers attached thereon and being position within the spaced forms and in spaced relationship relative to the first insulation panel to thereby define the T-beam cavity for forming the T-beam support during the concrete pouring operation.

Now after the first section of forms 30A, 30B with the installation of a first panel 16 therewithin is completed, as just described above, a second section of forms 30A, 30B, identical to said first form section, is erected and connected to the one open end of the completed first section form in the same manner with connecting pins 34 as is shown in FIG. 31. As in the first section, another or second insulation panel 16, identical to the one seen in FIG. 28, having the dumbbell spacers 36 mounted on one edge face 16A and with the single ring spacers 44 mounted on the rear face of the panel 16, is inserted into the wall cavity 29 defined between the outer and inner walls 30A, 30B of said second section of form 30 as shown in FIG. 32. Once said second insulation panel 16 is inserted completely into forms 30A, 30B of said second section and contacts the footer F therebelow, said second panel 16 is slid or shifted laterally (to the right) to the side toward the first insulation panel 16 in said first form section such that said corresponding edge face 16B of said second panel 16 is forced onto the projecting ends of dumbbell spacers 36 extending outwardly from the opposing edge face 16A of said first insulation panel 16 of said first form section such that said second insulation panel 16 is positioned and oriented in an identical fashion to said first insulation panel 16. As explained earlier with reference to FIGS. 18 and 19, the dumbbell spacers 36 maintain adjacent insulation panels 16 in a predetermined spaced-apart relation and define therebetween the support wall cavity 12E which forms the integral middle-leg 12B of the upright T-beam supports 12, and whereas, the single ring spacers 44 maintain the insulation panels 16 in a spaced relationship to the outer form 30A and define therebetween the outer wall cavity 12F which forms the integral cross-leg 12A of the upright T-beam supports 12. The second form section is then completed in the same manner as the first form section with the installation of channel 26 and the cross-ties 34 connecting the outer ends of form walls 30A, 30B together.

After the second section is completed as explained above, another or third consecutive section is completed in an identical procedure as said second section and this is repeated over and over again until the forms and panels are completely erected and installed for the intended wall structure to be built. Either during the above method steps or after same have been completed, the single rebar retainers 52 are installed in the box beam cavity 18A on the top surface of adjacent insulation panels 16 as described above with reference to FIGS. 20 and 21; the double rebar retainers 58 are installed in the box beam cavity 18A on the top of different ones of the insulation panels 16 as previously described with reference to FIGS. 22 and 23; single rebars 22 are inserted down through the loops 56 of spacers 52 and into the drill holes 22A in the footer F and are thereby disposed in the support wall cavity 12E; and double rebars 24 are supported on the corresponding half-loops 62 of retainers 58 and disposed in box beam cavity 18A for reinforcement of the box beam 18.

Uncured concrete is poured into the wall cavity 29 defined by the spaced apart forms 30 up to the top of the forms 30 in thereby filling the support wall cavities 12E which form the middle leg 12B of the T-beam supports 12; the outer wall cavity 12F which form the cross-leg 12A of the T-beam supports 12 and also the outer wall 14 of wall structure 10; and the box beam cavity 18A which forms the top box beam 18 at the upper end of the wall structure 10 and which is integrally interconnected to the footer F by the upright rebars 22. Once the concrete has cured, the forms 30 are removed for re-use, leaving an insulated wall structure 10, as shown in FIGS. 1 and 3, with upright T-beam supports 12 integrally connected to the bottom footer F and integrally connected to the top box-beam 18 that integrally connects the upper ends of the T-beam supports 12.

It is thought that the wall structure and method of forming same of the present invention and many of its attendant advantages will be understood from the foregoing description and it will be apparent that various changes made be made in the form, construction and arrangement thereof without departing from the spirit and scope of the invention or sacrificing all of its material advantages, the form hereinbefore described being merely a preferred or exemplary embodiment thereof.

I claim:

1. A method of forming an insulated poured concrete wall structure onsite having an outer wall and integral concrete T-beam supports, comprising the steps of:

(a) erecting a pair of spaced apart inner and outer forms on a base in defining a wall cavity therebetween for receiving uncured concrete;

(b) placing a series of insulation panels having opposite side edges and opposite front and rear faces into the wall cavity and positioning said insulation panels within said wall cavity such that the front face of each insulation panel abuts against an inner face of the inner form and the rear face of each insulation panel is spaced away from an inner face of the outer form in defining an outer wall cavity having a horizontal thickness which forms a cross-leg of a T-beam support when filled with concrete and such that the respective side edges of adjacent insulation panels are spaced apart in defining a plurality of support wall cavities which form a middle-leg of said T-beam support when filled with concrete, each support wall cavity extending perpendicular inwardly from and integral with said outer wall cavity and having a horizontal thickness at least as thick as the horizontal thickness of said outer wall cavity; and (c) pouring uncured concrete onsite into said outer wall cavity and said plurality of support wall cavities in forming a unitary, insulated wall structure having a plurality of integral concrete T-beam supports with the cross-leg of each T-beam support being integral with one another in thereby forming a continuous unitary outer wall of said wall structure.

2. The method of forming an insulated poured concrete wall structure as recited in claim 1, further comprising the step of:

providing a box beam cavity at an upper end portion of said inner and outer forms and extending above and integral with said outer wall cavity and said support wall cavity for forming a horizontally extending box beam during the pouring of said uncured concrete such that said outer wall, said support wall and said box beam are structurally interconnected.

3. The method of forming an insulated poured concrete wall structure as recited in claim 2, further comprising the step of:

suspending at least one horizontally extending rebar within said box beam cavity prior to pouring of the uncured concrete for added structural strength of said wall structure after the uncured concrete has cured.

4. The method of forming an insulated poured concrete wall structure as recited in claim 3, wherein suspending of said at least one horizontally extending rebar within said box beam cavity includes supporting said at least one rebar on a horizontal rebar retainer attached to a top edge of each of said series of spaced apart insulation panels.

5. The method of forming an insulated poured concrete wall structure as recited in claim 2, further comprising the steps of:

providing a series of aligned spaced apart holes in said base; and suspending at least one vertically extending rebar within at least one of said pluralities of support wall cavities with one end of said rebar being disposed within said box beam cavity and the other end of said rebar being disposed within one of said spaced apart holes provided in said base for structurally integrally interconnecting said box beam, said T-beam supports and said base together.

6. The method of forming an insulated poured concrete wall structure as recited in claim 5, wherein said vertically extending rebar at an upper end is supported by a vertical rebar retainer attached to the upper end of adjacent insulation panels.

7. The method of forming an insulated poured concrete wall structure as recited in claim 1, wherein said series of insulation panels are equally spaced apart along said inner surface of said inner form.

8. The method of forming an insulated poured concrete wall structure as recited in claim 1, wherein the width thickness of each of said support walls formed by said plurality of support wall cavities is at least twice the depth thickness of said outer wall formed by said outer wall cavity.

9. The method of forming an insulated poured concrete wall structure as recited in claim 8, wherein the depth thickness of each of said plurality of support walls formed by said plurality of support wall cavities is approximately equal to the depth thickness of an insulation panel.

10. The method of forming an insulated poured concrete wall structure as recited in claim 1, wherein said series of insulation panels are equally spaced apart along said inner surface of said inner form by providing a plurality of spacers extending between adjacent panels during the positioning of said panels within said wall cavity.

11. The method of forming an insulated poured concrete wall structure as recited in claim 1, wherein said series of insulation panels are spaced away from said inner surface of said outer form by inserting wall spacers between said outer wall form and said rear face of said insulation panels during the positioning of said panels within said wall cavity prior to pouring of the uncured concrete.

12. A method of forming an insulated poured concrete wall structure onsite having integral concrete T-beam supports, comprising the steps of:

(a) erecting a pair of spaced apart inner and outer forms on a base in defining a wall cavity therebetween for receiving uncured concrete;

(b) placing a series of insulation panels having opposite side edges and opposite front and rear faces into the wall cavity and positioning said insulation panels within said wall cavity such that the front face of each insulation panel abuts against an inner face of the inner form and the rear face of each insulation panel is spaced away from an inner face of the outer form in defining an outer wall cavity having a horizontal thickness and such that the respective side edges of adjacent insulation panels are spaced apart in defining a plurality of support wall cavities each being perpendicular to and integral with said outer wall cavity and each having a horizontal thickness at least as thick as the horizontal thickness of said outer wall cavity;

(c) pouring uncured concrete onsite into said outer wall cavity and said plurality of support wall cavities in thereby forming a unitary, insulated wall structure having a plurality of integral T-beam supports;

(d) positioning a vertically extending C-shaped channel within each of said plurality of support wall cavities and locating said channel between the side edges of adjacent insulation panels with an open face of said channel directed toward said inner surface of said inner form prior to the step of pouring concrete into said support wall cavities; and (e) after the uncured concrete have cured and said inner and outer forms have been removed, inserting an insulation panel into each of said C-shaped channels whereby an interior surface of said wall structure is completely covered with insulation material and presents a relatively continuous, non-interrupted planar surface.

13. A method of forming an insulated poured concrete wall structure on-site having integral concrete T-beam supports, comprising the steps of:

(a) erecting a plurality of inner and outer forms on a concrete footer in a spaced apart relationship along said footer in defining a wall cavity between said forms for receiving uncured concrete;

(b) placing a series of rectangular shaped insulation panels within said wall cavity defined by said paced apart inner and outer forms, each of said insulation panels having upper and lower opposite ends, opposite side edges and opposite front and rear faces;

(c) positioning said series of insulation panels within said wall cavity in an aligned row in a side edge to side edge manner along said inner form such that said front face of said insulation panels abut against said inner form and said rear face of said insulation panels are spaced away from said outer form in thereby defining an outer wall cavity for forming an outer concrete wall of said wall structure and a cross-leg of a plurality of upright T-beam supports to be formed upon pouring of uncured concrete;

(d) spacing said aligned row of insulation panels along said inner form in a spaced apart relationship such that the space between the opposite side edges of adjacent insulations panels is at least equal to the horizontal thickness of said outer wall cavity in thereby defining a support wall cavity perpendicular and projecting inwardly from said outer wall cavity and which forms a unitary middle-leg of said T-beam supports to be formed upon pouring of uncured concrete;

(e) providing an elongated box beam cavity at an upper end of said inner and outer forms extending over and along said outer wall cavity and over and across said support wall cavity and upper ends of said series of spaced apart insulation panels for forming an elongated box beam upon pouring of uncured concrete which forms the top surface of said wall structure for integrally interconnecting said plurality of T-beam supports together; and (f) pouring uncured concrete onsite into said wall cavity defined by said spaced apart inner and outer forms so as to fill with uncured concrete said outer wall cavity, said support wall cavity and said box beam cavity to thereby form a unitary concrete wall structure having T-beam supports and a box beam that integrally interconnects said T-beams together for structural integrity of said wall structure; and (g) providing a series of aligned spaced apart bore-holes in said concrete footer and suspending at least one vertically extending rebar within at least one of said pluralities of support wall cavities with one end of said rebar being disposed within said box beam cavity and the other end of said rebar being disposed within one of said spaced apart bore-holes provided in said concrete footer for structurally integrally interconnecting said box beam, said T-beam supports and said concrete footer together.

14. The method of forming an insulated poured concrete wall structure as recited in claim 13, further comprising the step of:

suspending at least one horizontally extending rebar within said box beam cavity prior to pouring of the uncured concrete into said wall cavity.

* * * * *